United States Patent [19]

Asick et al.

[11] Patent Number: 4,842,549

[45] Date of Patent: Jun. 27, 1989

[54] DUAL DIAMETER CABLE STRAIN RELIEF

[75] Inventors: John C. Asick, Harrisburg; Stephen M. Yingst, Hummelstown, both of Pa.

[73] Assignee: AMP Incorporated, Harrisburg, Pa.

[21] Appl. No.: 177,795

[22] Filed: Apr. 6, 1988

Related U.S. Application Data

[63] Continuation of Ser. No. 39,556, Apr. 16, 1987, abandoned.

[51] Int. Cl.[4] ..... H01R 13/58

[52] U.S. Cl. ..... 439/464; 439/455

[58] Field of Search ..... 439/449, 451, 453, 455, 439/469, 465, 471; 29/857

[56] References Cited

U.S. PATENT DOCUMENTS

| | | | |
|---|---|---|---|
| 2,258,343 | 10/1941 | Walker | 439/455 |
| 3,170,749 | 2/1965 | Johanson et al. | 439/465 |
| 4,080,035 | 3/1978 | Clark et al. | 339/103 |
| 4,108,527 | 8/1978 | Douty et al. | 339/107 |
| 4,341,431 | 7/1982 | Woratyla | 339/103 |
| 4,367,005 | 1/1983 | Douty et al. | 339/107 |
| 4,448,471 | 5/1984 | Berry et al. | 339/91 |
| 4,561,715 | 12/1985 | Sanchez | 339/103 R |
| 4,603,936 | 8/1986 | Jager | 339/143 |
| 4,710,137 | 12/1987 | Perdue et al. | 439/465 X |
| 4,762,505 | 8/1988 | Asick et al. | 439/347 |
| 4,798,542 | 1/1989 | Asick et al. | 439/188 |

FOREIGN PATENT DOCUMENTS

| | | | |
|---|---|---|---|
| 1181504 | 1/1985 | Canada | 339/48 |

*Primary Examiner*—Eugene F. Desmond

*Attorney, Agent, or Firm*—David L. Smith

[57] ABSTRACT

A connector assembly (24) for terminating a cable (102) includes a two-piece housing (80, 98) having therein a dual-diameter strain relief (200, 202, 159) incorporated in a cylindrical channel (166). The channel (166) has a smaller diameter portion (200) adjacent the termination of the cable conductors (154) and a larger portion (202) adjacent and axially aligned with the smaller diameter portion (200). Forces on cable (102) are transferred from cable (102) to covers (80, 98) through a cable tie in a recess (212, 220) appropriate for the diameter of the cable.

9 Claims, 8 Drawing Sheets

DUAL DIAMETER CABLE STRAIN RELIEF

BACKGROUND OF THE INVENTION

This invention relates to strain relief of cables terminated to connectors and in particular to a dual diameter cable strain relief for transferring forces to which the cable is subjected to the connector housing rather than allowing the forces to act on the point of termination of the individual conductors.

Prior art strain relief mechanisms typically have a connector component that applies pressure to the cable on one side and squeezes the cable against another connector component on the other side of the cable. Use of a connector with different diameter cable is achieved by ho the two connector members are secured together thereby providing a variable area therebetween. Typical prior art strain relief means require a large force to hold the two connector components together any forces on the cable are transferred to the connector housing.

SUMMARY OF THE INVENTION

In accordance with the present invention, a connector includes a two-piece housing having a dual diameter strain relief with a cylindrical channel for enclosing the cable and conductors. The cylindrical channel has a smaller diameter portion adjacent the termination of the conductors to the connector and a larger diameter portion adjacent and axially aligned with the smaller diameter portion. Smaller diameter cable is strain relieved in the smaller diameter portion of the channel. For smaller diameter cable, a cable tie is tightened around the cable and positioned in a recess in the smaller diameter portion of the channel. Small protrusions in the channel provide an interference fit of the cable in the channel. With the two-piece housing latched together, stress on the cable is transferred from the cable to the housing through the cable tie and recess. Strain relieving a larger diameter cable operates in a similar manner with a cable tie received in a recess in the larger diameter portion of the channel.

DESCRIPTION OF THE PREFERRED EMBODIMENT

Figure 1:
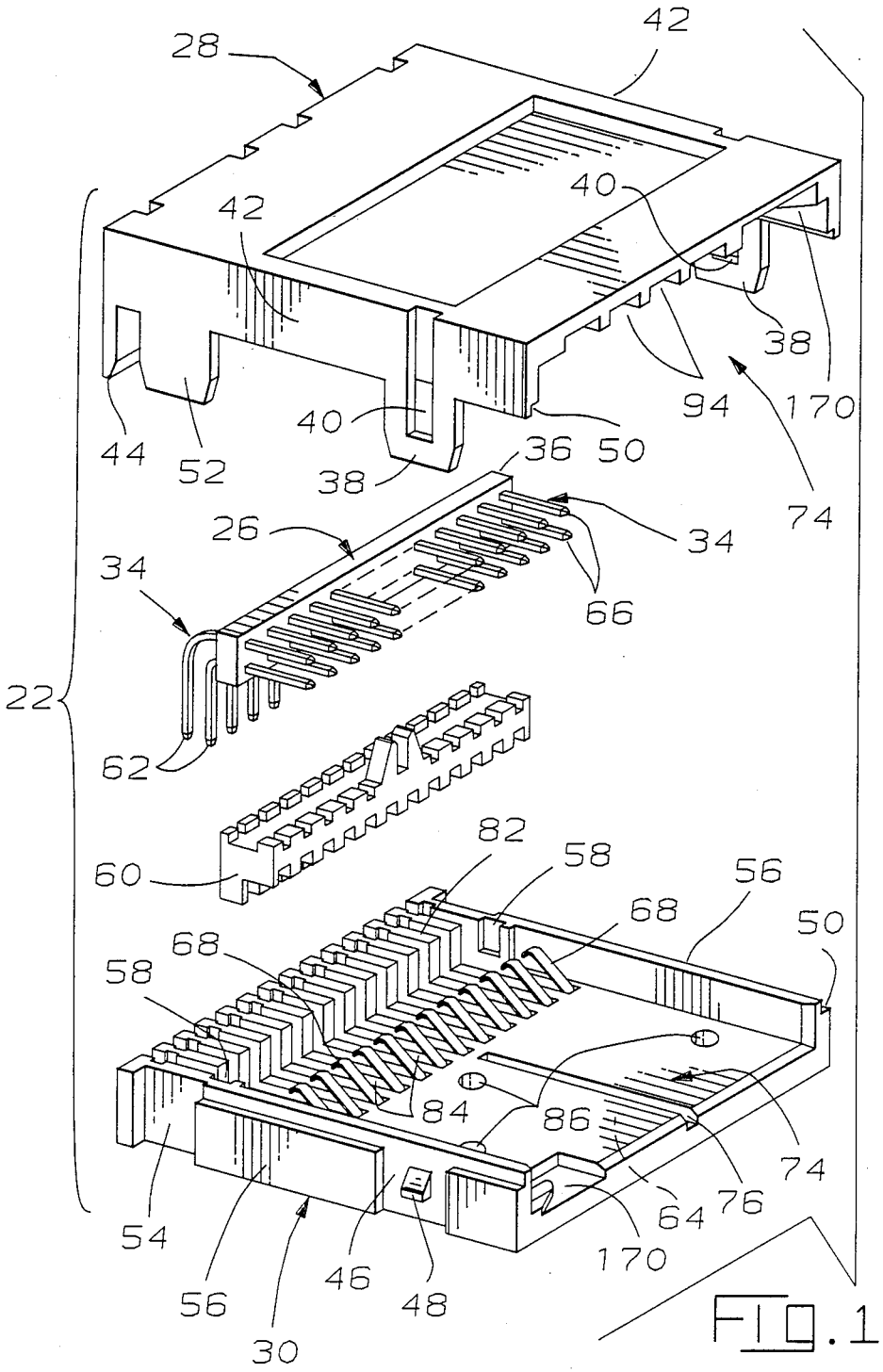
FIG. 1 is an exploded perspective of the header assembly of an input/output connector system in accordance with the invention.

Input/output connector system 20 is comprised of header assembly 22 and receptacle assembly 24 each of which is molded of an insulative thermoplastic. Header assembly 22 provides a shroud that aids in alignment and is comprised of pin header 26 secured between upper shell 28 and lower shell 30. Pin header 26 is an array 32 of pins 34, typically 0.025 inch square on 0.100 inch center array, secured in insulating spacing member 36. Pins 34 shown in FIGS. 1 are right angle but are not limited thereto; pins 34 may be straight providing a vertical array 32 of pins 34. In a preferred embodiment the array 32 of pins 34 are arranged in two rows.

Upper shell 28 has latches 38 having apertures 40 therein in sidewalls 42 and endwall 44. Latches 38 are received in channels 46 with catches 48 seating in apertures 40 and securing upper and lower shells 28, 30. Sidewalls 42 of upper shell 28 and sidewalls 56 of lower shell 30 have complementary interengaging offset ridges 50 for stability. Guides 52 in sidewalls 42 of upper shell 28 are received in channels 54 of sidewalls 56 and aid in properly positioning upper and lower shells 28, 30 during assembly.

The end of spacing member 36 is received in channels 58 in sidewalls 42 and 56. Hold down bar 60 provides a spacing function so that a standard spacing member 36 may be used. With spacing member 36 received in channels 58, the first end 62 of pins 34 extend beyond the lower surface 64 of lower shell 30. The lower surface 64 provides a mounting face for header assembly 22. The second end 66 of pins 34 engage spring contacts 68. Spring contacts 68 have a mounting portion 70 that extends beyond the mounting face provided by lower surface 64. Pin engaging portion 72 of each spring contact 68 is biased by the spring action of spring contact 68 to contact the second end 66 of a pin 34 of pin array 32.

With upper shell 28 latched to lower shell 30, shells 28, 30 define cavity 74 therebetween for receiving receptacle assembly 24. Lower shell 30 has a polarization slot 76 axially along the mating direction. A complementary polarization protrusion 78 extends from lower cover 80 of receptacle assembly 24.

The mounting face, provided by lower surface 64 when pins 34 form a right angle, has means for securing the header assembly to a printed circuit board. In a preferred embodiment, the securing means are mounting leg means 86 (see FIG. 12) extending normal to lower surface 64. Each of the mounting leg means has an outer cylindrical profile and is comprised of a plurality of integral depending leg portions 88 each with an outwardly directed arcuate detent shoulder 90 adjacent the free end thereof. Space 92 between leg portions 88 provides for inward deflection thereof upon tapered ends 94 entering an aperture in the printed circuit board. Shoulders 90 are spaced from surface 64 substantially the thickness of the printed circuit board such that leg portions 88 deflect outwardly as shoulders 90 pass beyond the thickness of the printed circuit board.

Keying of header assembly 22 and receptacle assembly 24 is provided by keying recesses 94 in upper shell 28 and corresponding insertable protrusions 96 in upper cover 98 of receptacle assembly 24.

Receptacle assembly 24 includes a complementary connector 100, matable with header assembly 22, to be received in cavity 74. Connector 100 may be of the type disclosed in U.S. Pat. No. 4,243,288, which is hereby incorporated by reference, and is sold by the Assignee of the present application under the trade name AMP-MODU. Connector 100 has terminals 164 having a mating portion directed toward mating face 182 for mating with pins 34 and a conductor terminating portion, typically an insulation displacing contact, directed away from mating face 182 for terminating conductors 154 of cable 102. Cable 102 may be shielded.

Figure 2:
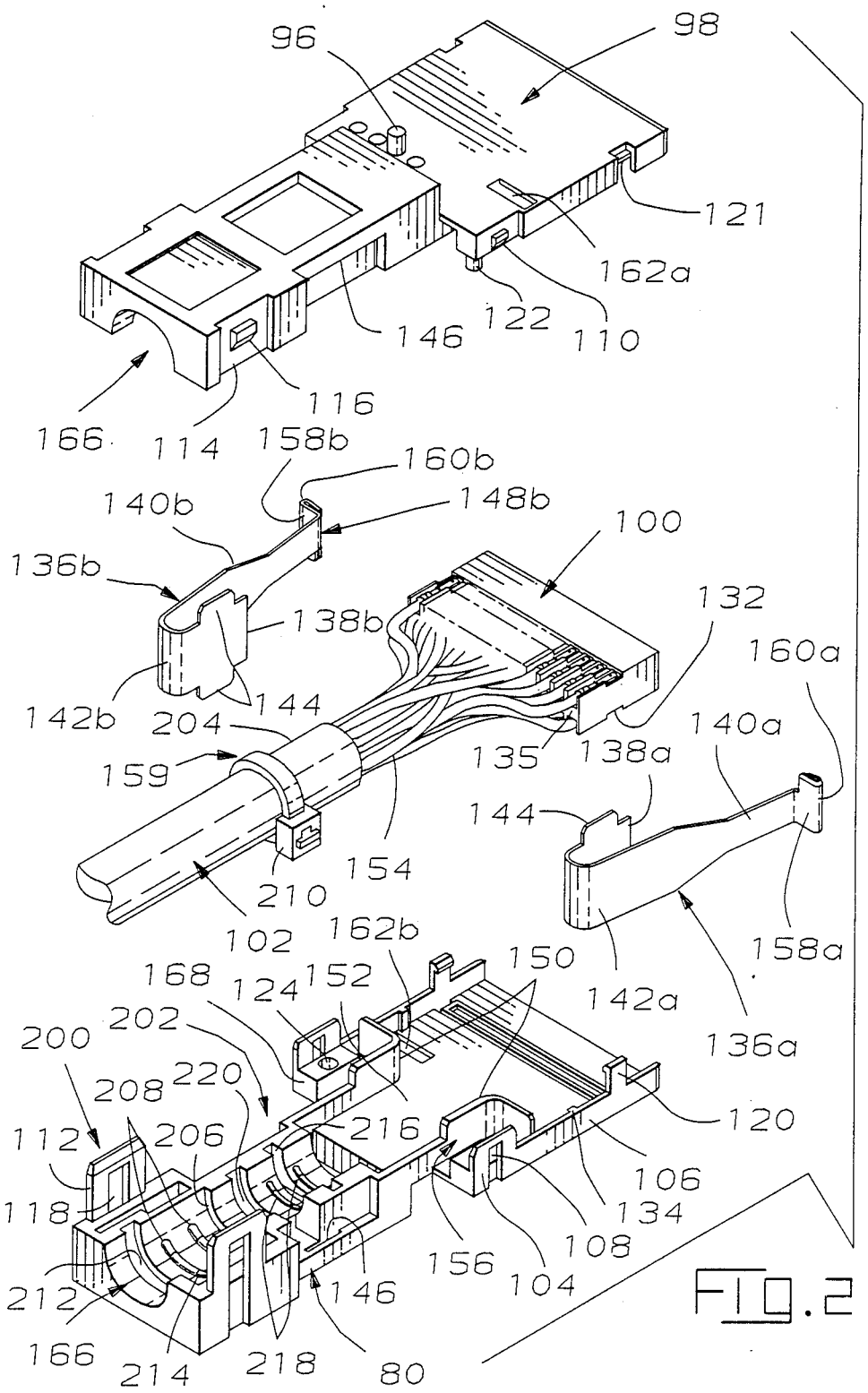
FIG. 2 is an exploded perspective view of the receptacle assembly of an input/output connector system, matable with the header assembly of FIG. 1.

As shown in FIG. 2, covers 98 and 80 are very similar, each having a forward mating portion and a rearward cable strain relief portion. Lower cover 80 has latches 104 in sidewalls 106 with apertures 108 therein, which receive catches 110 on cover 98. Latches 112 in the cable strain relief portion of lower cover 80 are received in channels 114 with catches 116 on upper cover 98 seating in apertures 118. Latches 120 on sidewalls 106 engage a small lip 121 on upper cover 98.

Connector 100 is maintained in position between covers 80 and 98 by lateral ribs 130 in covers 80 and 98 extending into transverse channels 132 of the housing of connector 100. The position of connector 100 is further maintained by vertical ribs 134 engaging the rear surface 135 of the housing of connector 100.

Latches 136 in the preferred embodiment are stamped and formed from a spring metal such as stainless steel. Latches 136 comprise first and second arms 138, 140, connected by a bight 142 to yield a generally U-shaped profile. First arm 138 has integral mounting extensions 144 that are received in recesses 146 in upper and lower covers 98, 80 thereby mounting latches 136 to receptacle assembly 24. Second arm 140 extends from bight 142 toward the distal end 148 thereof between conductor guide 150 and sidewalls 106. Conductor guides 150 provide a channel 152 though which individual conductors 154 pass between connector 100 and the cable stress relieving portion. Cable guides 150 thereby provide a region 156 free of interference with conductors 154 in which the distal end 148 of second arm 140 can move substantially transverse to the axis of cable 102, albeit while the latch being a spring flexes along its length.

The distal end 148 of second arm 138 is formed normal to the plane of second arm 138 providing catch 155 having latching surface 158 thence is folded back onto itself providing arcuate surface 160 at the fold. With receptacle assembly 24 assembled, latching surface **158*a* extends through aperture 162*a* in upper cover 98 and beyond upper cover 98. Latching surface 158*b* extends through aperture 162*b* in lower cover 80 and beyond lower cover 80. Catches 155 in the preferred embodiment provide a balanced latching of header assembly 22 with receptacle assembly 24. Latching means for securing the two assemblies 22, 24 can take other forms. For example, each catch 155 could extend through apertures in both upper cover 98 and lower cover 80 to operate in channels in the housing of receptacle assembly 24**. Latching means could provide an unbalanced latching with a single off-centered latching means.

After individual conductors 154 are terminated to terminals 164 in conductor 100, conductors 154 are passed through channel 152 while cable 102 is positioned in channel 166. Connector 100 is positioned in lower cover 80 as described above. Latches 136 are incorporated in the assembly by inserting extensions 144 into recesses 146 at an angle, biasing second arm 140 toward lower cover 80 and down over stop 168 into final, biased position against stop 168. When latch **136*b* is incorporated into the assembly, a portion of catch 155** *a* extends through aperture **162*b* as described above. Upper cover 98 is then assembled with stakes 122 entering recesses 124 guiding the covers 80, 98 together. Extensions 144 enter recesses 146 in upper cover 98, a portion of catch 155*a* extends through aperture 162** *a* and the various latches and cooperating catches engage to secure lower cover 80 to upper cover 98 with connector 100 and cable 102 secured therebetween. Spring contacts 68 are deflected away from their unbiased position (see the phantom spring contact **68*a* in FIG. 12) during assembly and are biased against pins 34** thereby providing a springing engagement therewith.

As receptacle assembly 24 is mated with header assembly 22, individual circuits are completed from conductors 154 of cable 102 through a corresponding terminal 164 in connector 100 and through a pin 34 to a circuit on a printed circuit board. Simultaneously latches 136 operate in channels 170 to secure receptacle assembly 24 to header assembly 22.

Figure 8:
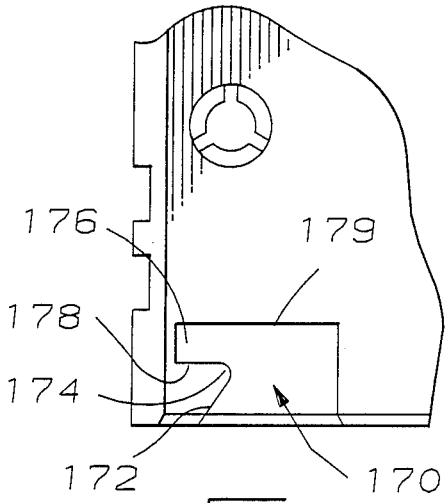
FIG. 8 is an enlarged partial plan view of a header assembly shell showing latching channels.

FIG. 8 shows an enlarged partial plan view of a header assembly shell 28 or 30 showing channels 170. As receptacle assembly 24 mates with header assembly 22, catch 155 of distal end 148 of latches 136 that extends beyond covers 80 and 98 enter channels 170. Arcuate surface 160 rides up ramp 172 further biasing latch 136 toward the axis of cable 102. As mating continues, arcuate surface 160 slides over arcuate corner 174 and the spring bias of latch 136 causes arcuate surface 160 and catch 155 including latching surface 158 to snap into and seat in detent 176, typically with an audible click.

Figure 10:
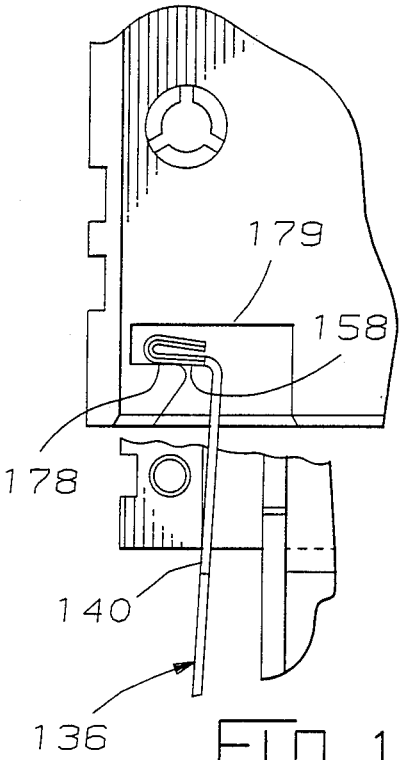
FIG. 10 is a partial plan view of a receptacle assembly cover cut away with the latch shown operating in the latching channel.

In the latched state shown in FIG. 10, second arm 14 is biased away from the axis of cable 102. In the preferred embodiment, second arm 140 engages stop 168 rather than arcuate surface 160 bottoming out in detent 176. The spring bias provided by the latches 136 retains arcuate surface 160 in detent 176.

Figure 9:
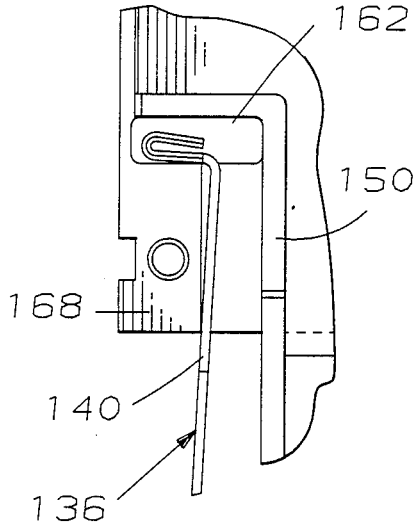
FIG. 9 is a partial plan view of a receptacle assembly cover showing a latch, stop and aperture.

FIG. 9 shows a view of latch 136 in the latched state with catch 155 including latching surface 158 and arcuate surface 160 operating in aperture 162.

Receptacle assembly 24 is demated by pressing on second arms 140 between the bright 142 and distal end 148 causing catches 155 to move laterally until arcuate surface 160 clears arcuate corners 174. A force axially along cable 102 great enough to overcome the contact 68 and terminal 164 demating forces then demates receptacle assembly 24 from header assembly 22.

Figure 11:
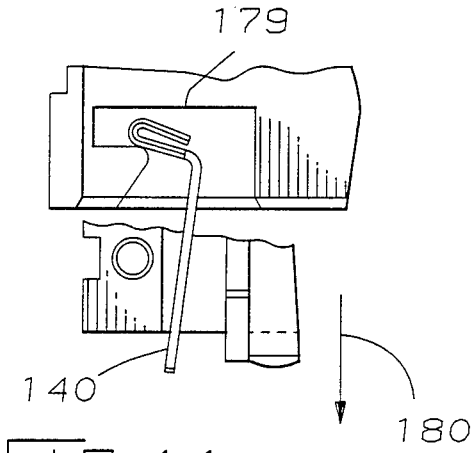
FIG. 11 is a partial plan view similar to FIG. 10 with a force applied in the direction of the arrow.

FIG. 11 is similar to FIG. 10 in that latch 136 is shown in the latched state, but with a force applied in the direction of arrow 180. The force deforms latch 136 in that catch 155 bends forwardly of the mating direction such that it is not normal to the plane of second arm 140. The angle between latching surface 158 and shoulder 178 increases as the applied force tends to rotate catch 155 around arcuate corner 174. Catch 155 at an angle with respect to shoulder 178 tends to slide across a portion of arcuate corner 174 with the planar portion 153 being axially displaced toward the axis of cable 102 until arcuate surface 160 rides over arcuate corner 174 releasing receptacle assembly 24 and permitting catch 155 to return to being substantially normal to planar portion 153 of second arm 140. Continued application of the force overcomes the contact demating force and demates receptacle assembly 24 from the shroud provided by header assembly 22. Clearance between catch 155 and forward edge 179 of channel 170 allows latches 136 to release when a force is applied to receptacle assembly 24. Often the force is applied to cable 102 and transferred to receptacle assembly 24 by a strain relief 159 system.

Latches 136 withstand a predetermined force before releasing. Preloading latches 136 in that latches 136 are spring biased against stops 168 during assembly increases the force that can be withstood before releasing. The force range can be varied by selection, thickness and other characteristics of the material from which latches 136 are made as well as varying the preloading of latches 136.

Figure 5:
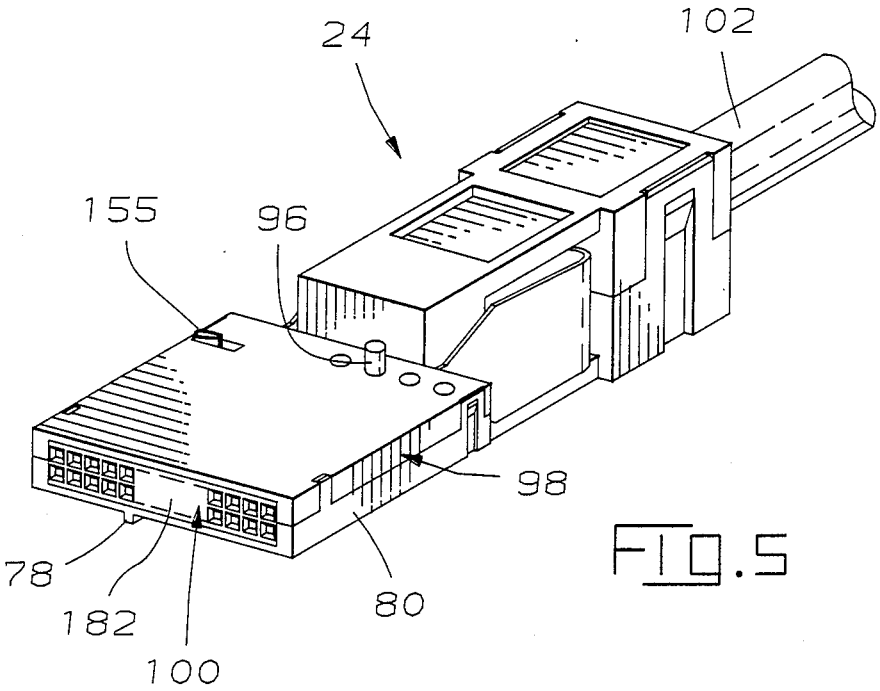
FIG. 5 is a perspective view of a receptacle assembly.

The FIG. 5 embodiment of receptacle assembly 24 shows upper and lower covers 98 and 80 terminating substantially flush with the mating face 182 of connector 100. This embodiment of receptacle assembly does not cause spring contacts 68 to be biased away from pins 34 and therefore may be used for a monitor function wherein both a circuit on printed circuit board 184 through spring contacts 68 and conductors 154 are electrically conductive with pins 34.

Figure 6:
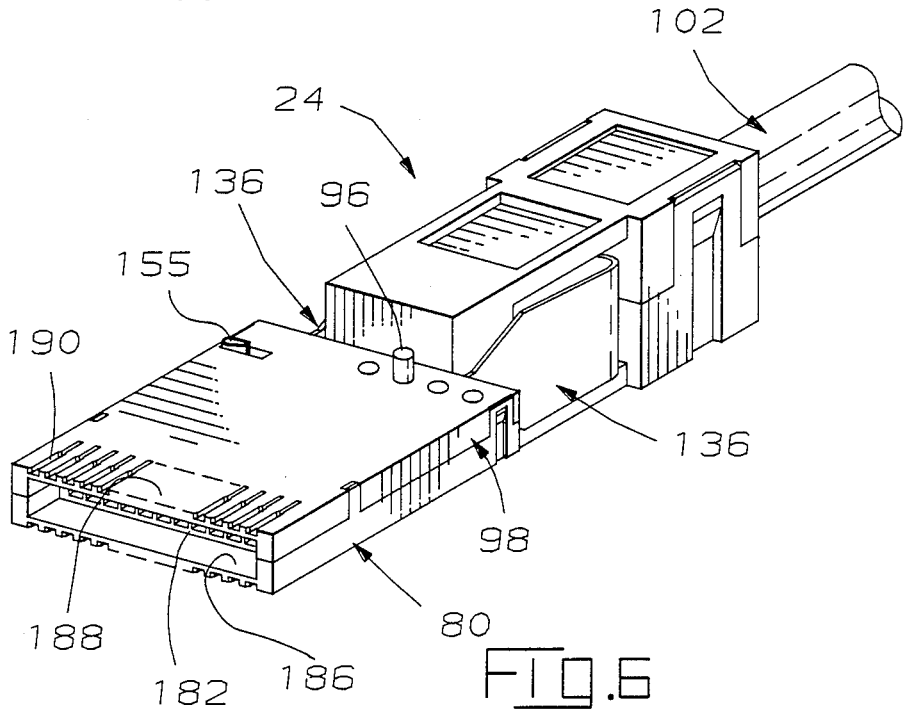
FIG. 6 is a perspective view of an alternate embodiment of a receptacle assembly.
Figure 7:
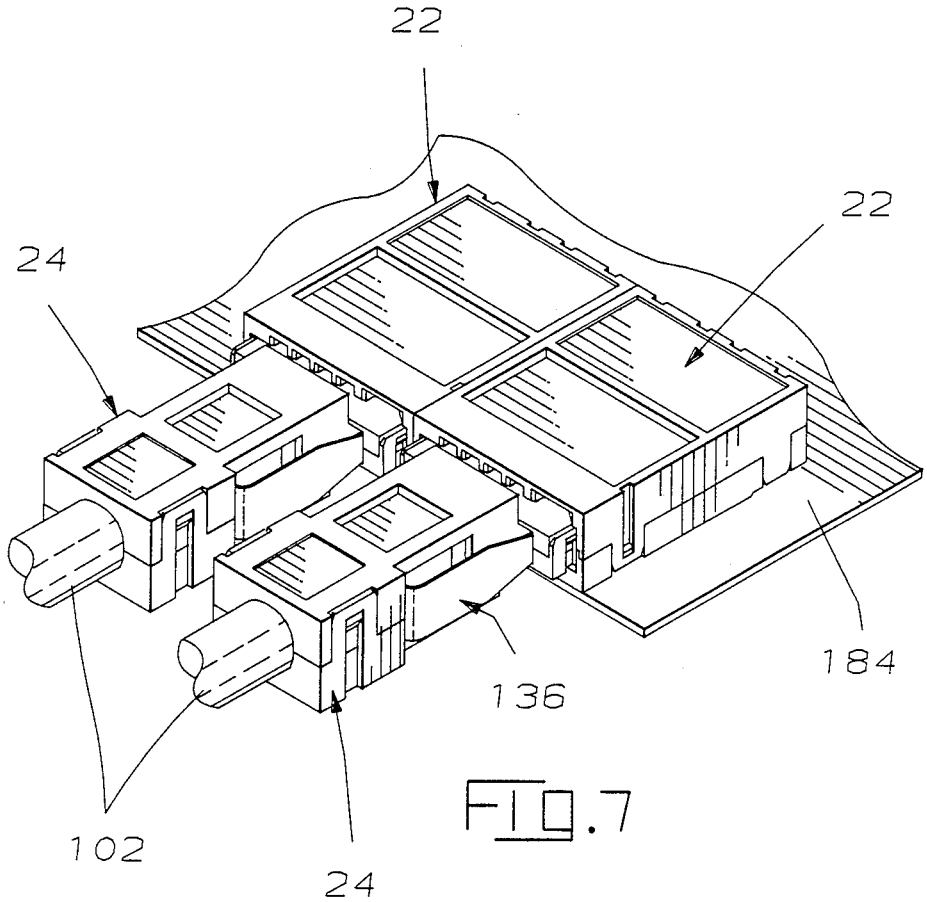
FIG. 7 is a perspective view of a pair of receptacle assemblies mated with a pair of circuit board mounted receptacle assemblies.

The FIG. 6 embodiment of receptacle assembly 24 shows upper and lower covers 98, 88 extending beyond the mating face 182 of connector 100 such that the mating face 182 is recessed. In this embodiment the extension of upper and lower coves 98,80 pass between spring contacts 68 and pins 34 to break the circuit therebetween. The length of extensions 186 and 188 relative to the point of contact between spring contacts 68 and pins 34 determines whether extensions 186 and 188 provide a make-before-break or break-before-make action as receptacle assembly 24 is mated with header assembly 22. Channels 190 provide for an insulative material to pass between contact 68 and pin 34 minimizing the deflection of contacts 68 into recess 84.

Figure 12:
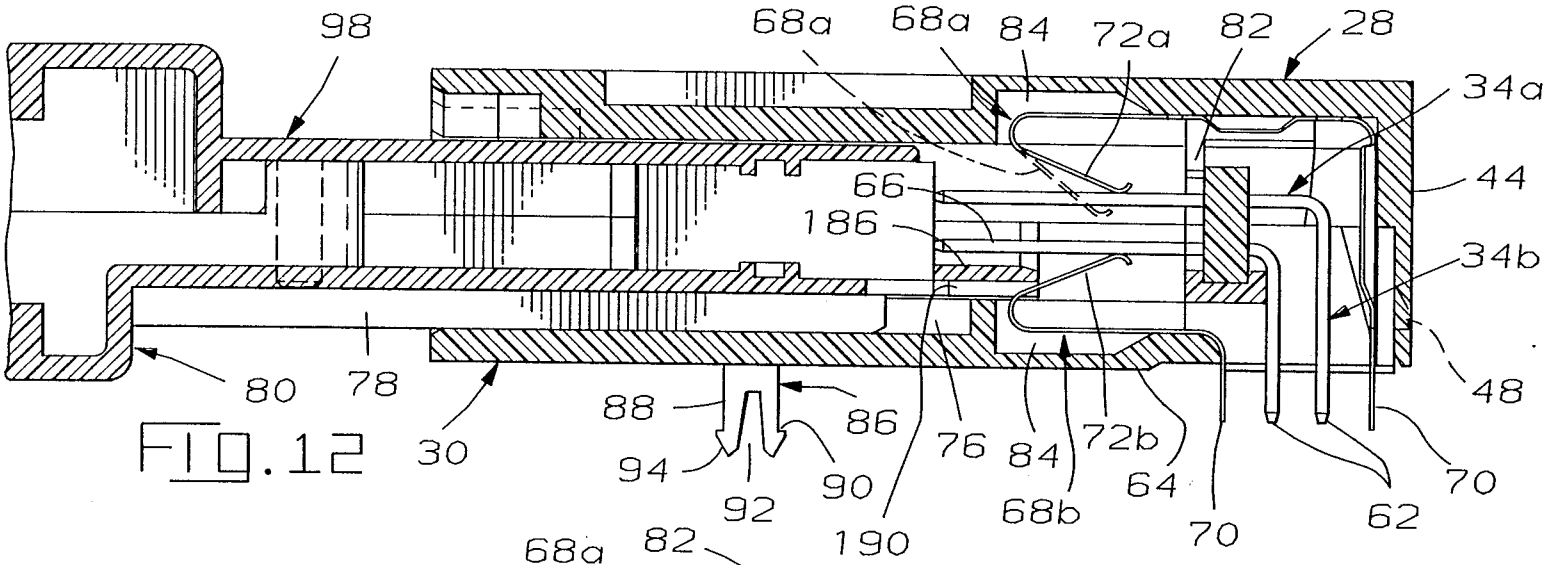
FIG. 12 is a side section view of an embodiment of an input/output connector system with the receptacle assembly received in a cavity of the header assembly prior to engagement of contacts therebetween.
Figure 13:
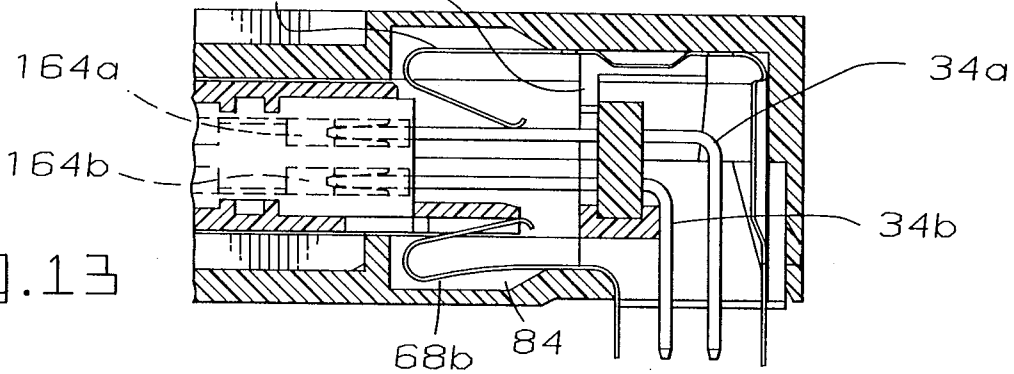
FIG. 13 is a side section view of an embodiment of an input/output connector system with the receptacle assembly received in a cavity of the header assembly subsequent to engagement of contacts therebetween.

FIGS. 12 and 13 show an action sequence of side section views of an input/output connector system with receptacle assembly 24 received in cavity 74 of header assembly 22. Upper cover 98 is depicted as not having extension 188 while lower cover 80 is depicted as having extension 186.

The initial position of contacts 68*a* and 68*b* are shown in FIG. 12 engaging respectively pins 34*a* and 34*b* as would exist with receptacle assembly 24 demated from header assembly 22. With receptacle assembly 24 inserted into cavity 74, extension 186 is poised to deflect spring contact 68*b* in a break-before-make action upon further insertion of receptacle assembly 24 into cavity 74.

FIG. 13 shows receptacle assembly 24 further inserted into cavity 74 and mated with header assembly 22. Pin 34*a* is in contact with terminal 164*a* and spring contact 68*a* remains in biased contact with pin 34*a* to provide a monitoring function. Pin 34*b* is in contact with terminal 164*b*. Spring contact 68b has been deflected away from pin 34*b* breaking contact therewith by extension 186. A portion of spring contact 68*b* has been deflected into cavity 84 and a portion has been deflected into cavity 190. Extension 186 insulates pin engaging portion 72*b* of spring contact 68*b* from pin 34 *b*. The length of extension 186 taken with the shape of spring contact 68 determines whether extension 186 provides a make-before-break action between terminals 164 and pins 34 as compared to between pins 34 and spring contacts 68 or whether a break-before-make action is provided.

Figure 14:
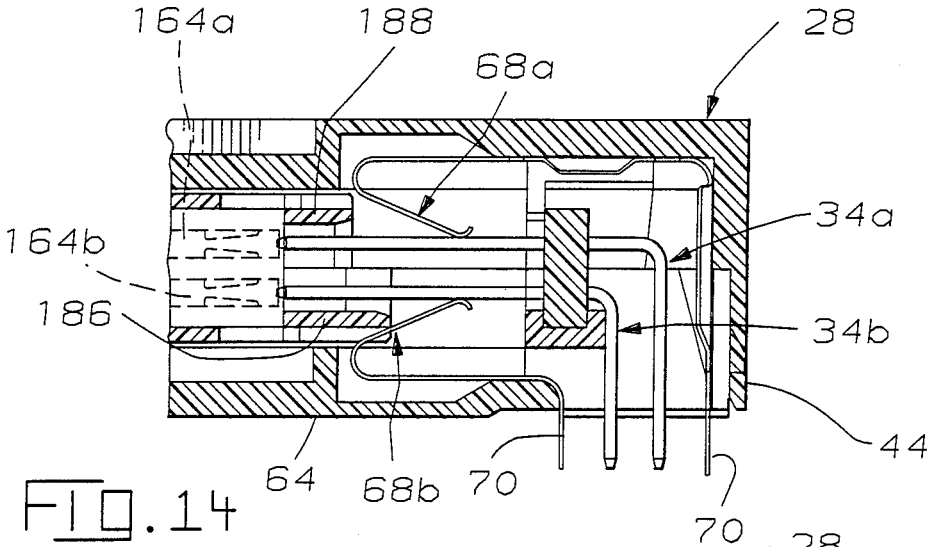
FIG. 14 is a side section view of an alternate embodiment of an input/output connector system with the receptacle assembly received in a cavity of the header assembly prior to engagement of contacts therebetween.
Figure 15:
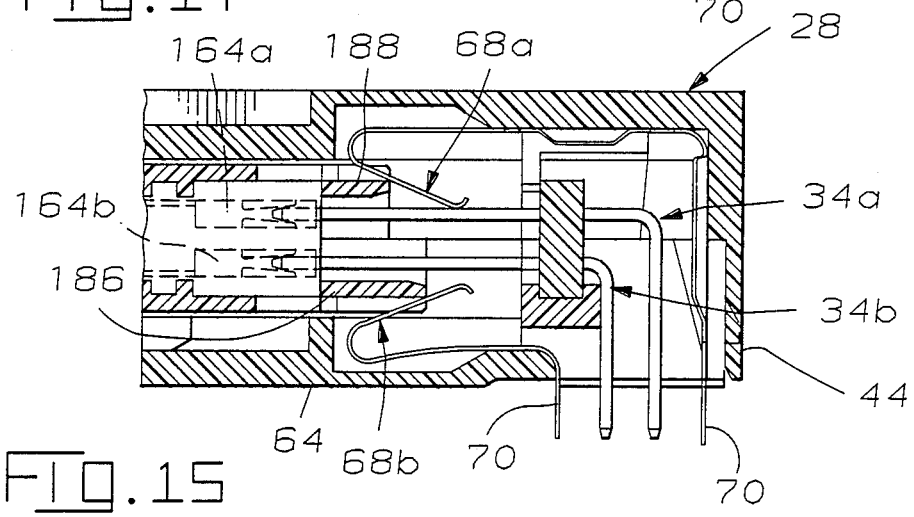
FIG. 15 is a side section view of an alternate embodiment of an input/output connector system with the receptacle assembly received in a cavity of the header assembly with the contacts initially engaged.
Figure 16:
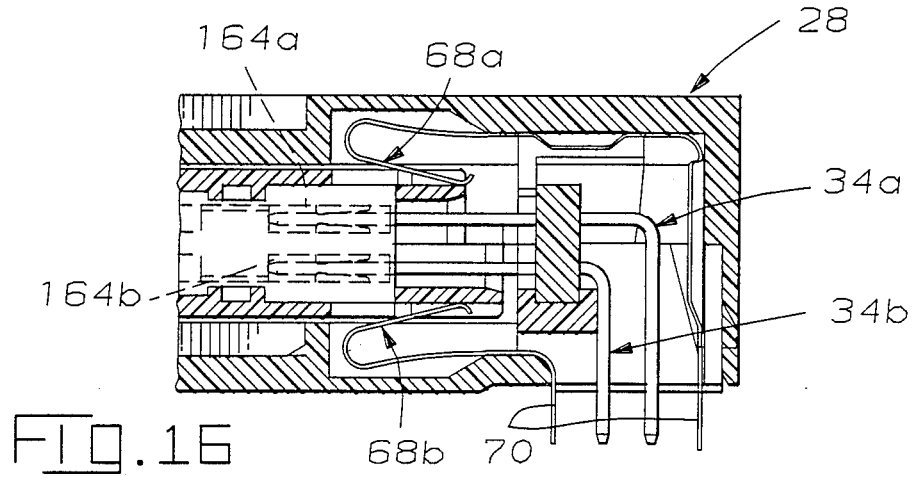
FIG. 16 is a side section view of an alternate embodiment of an input/output connector system with the receptacle assembly received in a cavity of the header assembly with the receptacle assembly fully engaged.

FIGS. 14-16 shown an action sequence of side section views of an input/output connector system with receptacle assembly 24 received in cavity 74 of header assembly 22. Upper cover 98 is depicted as having extension 188 that provides a make-before-break action between terminals 164*a* and pins 34*a* as compared to between pins 34*a* and spring contacts 68*a*. Lower cover 80 is depicted as having extension 186 that extends further from mating face 182 than extension 188 thereby providing a break-before-make action between terminals 164*b* and pins 34*b* as compared to between pins 34*b* and spring contacts 68*b*.

The initial position of contacts 68*a* and 68*b* are shown in FIG. 14 engaging respectively pins 34*a* and 34*b* as would exist with receptacle assembly 24 within cavity 74 demated from header assembly 22. Extension 186 is poised to deflect spring contact 68*b* in a break-before-make action upon further insertion of receptacle assembly 24 into cavity 74.

FIG. 15 shows an intermediate stage between an unmated and mated conditions with receptacle assembly 24 further inserted into cavity 74. Spring contact 68*a* remains in biased contact with pin 34*a*. Pin 34*a* is also in contact with terminal 164*a*. Pin 34*b* is in contact with terminal 164*b*. Spring contact 68*b* has been deflected away from pin 34*b* breaking contact therewith by extension 186.

FIG. 16 shows receptacle assembly 24 further inserted into cavity 74 and mated with header assembly 22. Pin 34*a* is in contact with terminal 164*a* and spring contact 68*a* is biased away from pin 34*a* and insulated therefrom by extension 188. Pin 34*b* is in contact with terminal 164*b* and spring contact 68*b* is biased away from pin 34*b* and insulated therefrom by extension 186.

The communication port of equipment which communicates over a buss or network is terminated in the characteristic impedance of the buss or network when not connected to the buss or network. The mode of termination is dictated by the mode of communication. The characteristic impedance circuit can be incorporated in a circuit conductive with the spring contacts 68 of an input/output connector system 20 in accordance with the present invention. Upon demating the receptacle assembly 24, with cable 102 representing the buss or network terminated thereto, from the header assembly 22, representing the buss or network port, the characteristic impedance circuit would simultaneously be switched to be conductive with pins 34 as spring contacts 68 engage pins 34. This obviates the need for a separate line terminator having the characteristic impedance of the communication port. It further assures that at all times when the network or buss is not connected to the communication port, the communication port is terminated in the characteristic impedance.

Cable 102 is strain relieved in the strain relief portion of receptacle assembly 24. For a connector 100 having a given number of terminals 164, cable 102 has a corresponding number of conductors 154, including a shield drain. The thickness of the insulation surrounding the individual conductors is greater for low capacitance cables than for non-low capacitance cables. The diameter of the cable 102 varies accordingly.

Cylindrical channel 166 provides a smaller diameter portion 200 adjacent and opening into the interior of the mating portion of receptacle assembly 24 and a larger diameter portion 202 adjacent and axially aligned with the smaller diameter portion 200.

Figure 3:
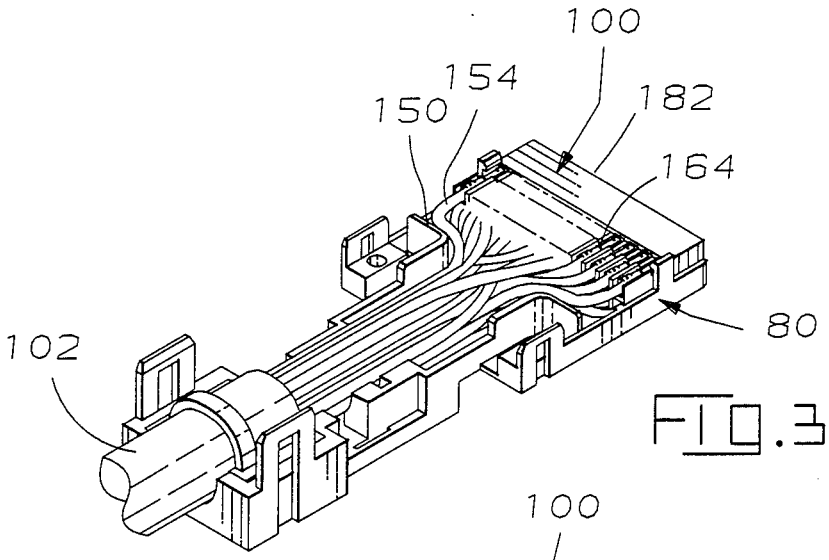
FIG. 3 is a perspective view of a cable terminated to a connector in the lower cover of the receptacle assembly.
Figure 4:
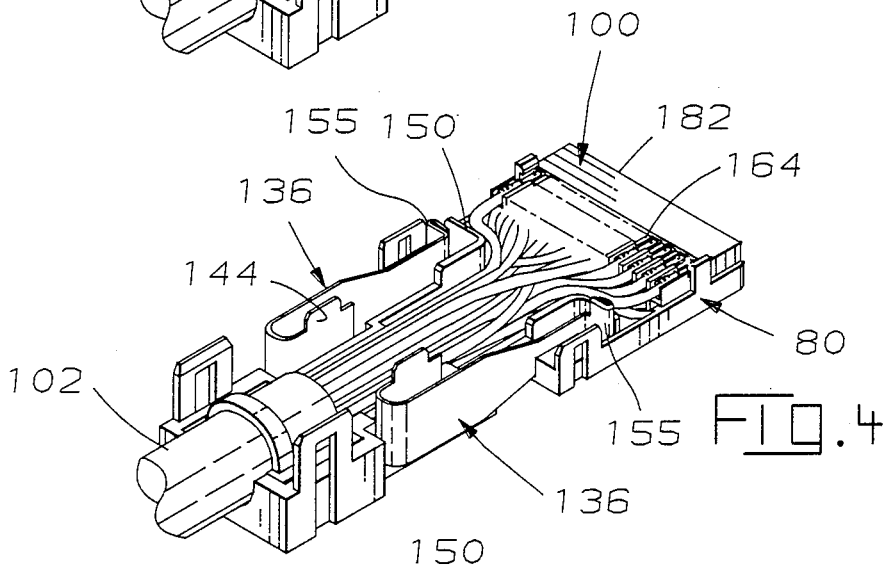
FIG. 4 is a perspective view showing latches added to the subassembly of FIG. 3.

Low capacitance cables 102 having a larger outside diameter are strain relieved in channel portion 202 as shown in FIGS. 3 and 4. The outside diameter of cable 102 is substantially the inside diameter of channel portion 202. Cable insulation 204 is stripped from the end of the cable 102 to allow for termination of the individual conductors 154 to terminals 164 of connector 100 and not to extend toward connector 100 beyond annular shoulder 206. Inwardly directed arcuate protrusions 208 in covers 98 and 80 center cable 102 in channel 166 and provide a slight interference fit.

A cable tie 159 having latching means 210 is tightened around the cable and positioned along cable insulation 204 to be received in annular recess 212 with latching means 210 received in recess 214. During assembly of receptacle assembly 24 connector 100 is positioned in cover 80, conductors 154 pass through channels 152 and 202 thence form cable 102. Cable 102 is placed in larger diameter portion with cable tie 159 received in recess 212 and latching means 210 received in recess 214. Upper cover 98 is then latched to lower cover 80 with very little force required. Forces on cable 102 are transferred from the cable 102 to covers 80, 98 through cable tie 159 and recess 212.

Figure 17:
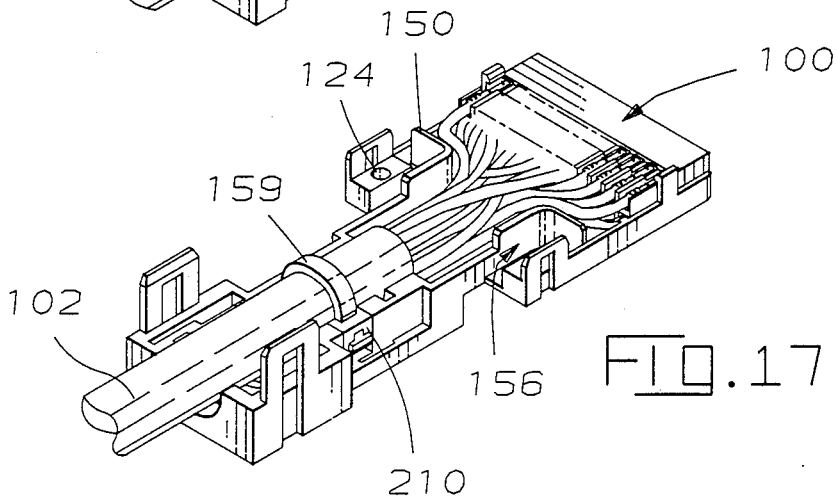
FIG. 17 is a perspective view of a smaller diameter cable terminated in the smaller diameter portion of the strain relief portion of the receptacle assembly.

A non-low capacitance cable having a smaller outside diameter is strain relieved in channel portion 200, as shown in FIG. 17. The outside diameter of cable 102 is substantially the inside diameter of channel portion 200. Cable insulation 204 is stripped from the end of the cable 102 to allow for termination of the individual conductors 154 to terminals 164 of connector 100 and not to extend toward connector 100 beyond shoulder 216. Inwardly directed arcuate protrusions 218 in covers 98 and 80 center cable 102 in channel 166 and provide a slight interference fit. A cable tie 159 is tightened around the cable as described above with reference to a low capacitance cable and received in annular recess 220. Cable 102 passes through larger diameter portion 202 of channel 166. Forces on cable 102 are transferred from cable 102 to covers 80, 98 through cable tie 159 and recess 220 in the manner described above with respect to the larger diameter portion of channel 166.

We claim:

1. An electrical connector assembly for providing strain relief to a cable received therein, the cable having a cable tie wrapped therearound, comprising:

an insulative housing having first and second covers and defining a mating section, a strain relief section having a cylindrical strain relief passage, and a channel therebetween, said mating section terminating in a mating face, said strain relief section of said first and second covers having a semi-cylindrical passage opening into said channel, said semi-cylindrical passage having a wall, a diameter substantially the same as the outside diameter of a cable to be received therein, and a recess in the passage wall forming a semicircular arc around the axis of the passage, said recess adapted to receive therein a cable tie surrounding the cable; and latching means on the first and second covers for detachably securing the first and second covers together, whereby the semi-cylindrical passages in the first and second covers form a cylindrical strain relief passage for receiving the cable and the semicircular recesses in the passage walls of the first and second covers form an annular recess for receiving the cable tie such that when the cable is received in the cylindrical strain relief passage and the cable tie is received in the recess, the cable tie engages wall means of the recess thereby preventing the cable from moving axially along the strain relief passage as forces to which the cable is subjected are transferred from the cable to the cable tie and recess, thence to the housing.

2. An electrical connector assembly as recited in claim 1 wherein the cable tie has securing means and the strain relief section of the first cover further comprises a recess adapted to receive the cable tie securing means therein.

3. An electrical connector assembly, comprising:

an insulative housing having first and second covers and defining a mating section, a strain relief section having a cylindrical strain relief passage, and a channel therebetween, said mating section terminating in a mating face, said strain relief section of said first and second covers having a semicylindrical passage opening into said channel, said semicylindrical passage having a wall, a diameter substantially the same as the outside diameter of a cable to be received therein, a recess in the passage wall forming a semicircular arc around the axis of the passage, said recess adapted to receive therein a cable tie surrounding the cable, said strain relief section of said first and second covers also having a further semicylindrical passage adjacent, opening into, and axially aligned with said semicylindrical passage, said further semicylindrical passage having a wall, a diameter greater than the diameter of said semicylindrical passage for receiving a greater diameter cable, said further semicylindrical passage having a recess in said further passage wall forming a semicircular arc around the axis of said further passage, the recess in said further passage adapted to receive therein a cable tie surrounding the greater diameter cable; and latching means on the first and second covers for detachably securing the first and second covers together, whereby the semicylindrical passages and further semicylindrical passage walls in the first and second covers form axially aligned cylindrical strain relief passages for receiving the cable and the semicircular recesses in the passage walls and further semicylindrical passage of the first and second covers form annular recesses for receiving the cable tie.

4. An electrical connector assembly as recited in claim 3 wherein the cable tie has securing means and the strain relief section of the first cover further comprises a recess in the wall of said further passage proximate the recess therein adapted to receive the cable tie securing means therein.

5. A method of providing strain relief to a cable in a connector assembly having a cable receiving passage defined by first and second covers, the cable receiving passage defining in a wall thereof a cable tie receiving recess, the method comprising the steps of:

securing a cable tie around a cable;

positioning the cable in the cable receiving passage of a first cover of the connector assembly;

positioning the cable tie in the cable tie receiving recess in the first cover of the connector assembly;

simultaneously positioning a securing portion of the cable tie in a local enlargement of the cable tie receiving recess; and positioning the second cover proximate the first cover, thereby completing the cable receiving passage defined thereby.

6. The method as recited in claim 5, further comprising the step of securing the first and second covers together.

7. An electrical connector assembly, comprising:

an insulative housing having first and second covers and defining a mating section, a strain relief section having a cylindrical strain relief passage defining a diameter, and a channel therebetween, said mating section terminating in a mating face, said strain relief section of said first and second covers having a semi-cylindrical passage opening into said channel, said semi-cylindrical passage having a wall and a recess in the passages wall forming a semi-circular arc around the axis of the passage, said first and second covers detachably secured together;

a cable having an outside diameter substantially the same as the diameter of the cylindrical strain relief passage, said cable received in said strain relief passage; and a cable tie, said cable tie wrapped around and secured to said cable, said cable tie received in said recess.

8. An electrical connector assembly as recited in claim 7 wherein said cable further extends into said channel.

9. An electrical connector assembly as recited in claim 7 further comprising latching means on said covers for detachably securing said covers together.

* * * * *